US007028673B2

(12) United States Patent
Itou et al.

(10) Patent No.: US 7,028,673 B2
(45) Date of Patent: Apr. 18, 2006

(54) EVAPORATIVE FUEL ADSORPTION DEVICE

(75) Inventors: Takaaki Itou, Mishima (JP); Koichi Hoshi, Susono (JP); Kouichi Oda, Chita (JP); Minoru Honda, Kariya (JP); Hideki Suzuki, Higashiura-cho (JP); Toshiki Annoura, Nagoya (JP); Masahiro Mochizuki, Okazaki (JP); Futaba Kanehira, Nagoya (JP)

(73) Assignees: Toyota Jidosha Kabushiki Kaisha, Toyota (JP); Toyota Boshoku Kabushiki Kaisha, Kariya (JP); Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/111,826

(22) Filed: Apr. 22, 2005

(65) Prior Publication Data

US 2005/0235967 A1 Oct. 27, 2005

(30) Foreign Application Priority Data

Apr. 27, 2004 (JP) ..... 2004-131614

(51) Int. Cl.
*F02M 37/04* (2006.01)

(52) U.S. Cl. ..... 123/516; 123/518; 123/519

(58) Field of Classification Search ..... 123/516, 123/518, 519

See application file for complete search history.

(56) References Cited

U.S. PATENT DOCUMENTS

| | | | | |
|---|---|---|---|---|
| 3,678,663 | A * | 7/1972 | Hansen | 96/141 |
| 4,300,511 | A * | 11/1981 | Lang | 123/520 |
| 5,912,368 | A * | 6/1999 | Satarino et al. | 55/320 |
| 6,474,312 | B1 * | 11/2002 | Zulauf et al. | 123/518 |
| 6,637,415 | B1 * | 10/2003 | Yoshioka et al. | 123/518 |
| 6,698,403 | B1 * | 3/2004 | Honda et al. | 123/520 |
| 6,817,345 | B1 * | 11/2004 | Lawrence | 123/518 |
| 6,835,237 | B1 * | 12/2004 | Ishida | 96/135 |

FOREIGN PATENT DOCUMENTS

| | | |
|---|---|---|
| JP | A 2001-227421 | 8/2001 |
| JP | A 2002-332924 | 11/2002 |

* cited by examiner

*Primary Examiner*—Thomas Moulis
(74) *Attorney, Agent, or Firm*—Oliff & Berridge, PLC

(57) ABSTRACT

An evaporative fuel adsorbent 32, which adsorbs evaporative fuel, is positioned substantially parallel to a sidewall surface 30 of a surge tank 22. A retention member 34 is positioned between the sidewall surface 22 and evaporative fuel adsorbent 32 to prevent oil, which runs down on the sidewall surface 22, from adhering to the evaporative fuel adsorbent 32. The evaporative fuel adsorbent 32 is mounted on the sidewall surface 30 of the surge tank 22 via the retention member 34.

5 Claims, 5 Drawing Sheets

EVAPORATIVE FUEL ADSORPTION DEVICE

BACKGROUND OF THE INVENTION

1. Field of the Invention

The present invention relates to an evaporative fuel adsorption device, and more particularly to an evaporative fuel adsorption device that is positioned in an intake path to adsorb evaporative fuel while an internal combustion engine is stopped.

2. Background Art

A conventional evaporative fuel adsorption device disclosed, for instance, by Japanese Patent Laid-open No. 2001-227421 is positioned in an internal combustion engine's intake path to adsorb evaporative fuel (HC). In this conventional evaporative fuel adsorption device, an evaporative fuel adsorbent is directly attached to the entire inner wall surface of a surge tank in the intake path. The use of the above conventional evaporative fuel adsorption device or other evaporative fuel adsorption device having an evaporative fuel adsorbent in the intake path makes it possible to adsorb HC remaining in the intake path during an internal combustion engine stop and inhibit the HC from leaking out of the intake path.

Including the above-mentioned document, the applicant is aware of the following documents as a related art of the present invention.

[Patent Document 1]

Japanese Patent Laid-open No. 2001-227421

[Patent Document 2]

Japanese Patent Laid-open No. 2002-332924

When a blowby gas flows backward into the intake path in an internal combustion engine, oil may flow into the intake path together with the blowby gas. If the oil flows into the intake path, it adheres to the inner wall surface of the intake path. When the above-mentioned conventional evaporative fuel adsorption device in which an evaporative fuel adsorbent is directly attached to the inner wall surface of the surge tank is used in the above instance, the oil may run down on the inner wall surface and adhere to the evaporative fuel absorbent. The oil has a high boiling point. Therefore, once the oil adheres to the evaporative fuel adsorbent, the oil is not likely to leave the evaporative fuel adsorbent. As a result, when the oil adheres to the evaporative fuel adsorbent, the HC adsorption capacity of the evaporative fuel adsorbent decreases.

SUMMARY OF THE INVENTION

The present invention has been made to solve the above problems. It is an object of the present invention to provide an evaporative fuel adsorption device that is capable of maintaining a stable adsorption capacity by preventing oil from adhering to an evaporative fuel adsorbent.

The above object is achieved by an evaporative fuel adsorption device which includes an evaporative fuel adsorbent disposed in an intake path to adsorb evaporative fuel. A oil adhesion prevention means that is positioned between an inner wall surface of the intake path and the evaporative fuel adsorbent to prevent oil running down on the inner wall surface from adhering to the evaporative fuel adsorbent is provided. The evaporative fuel adsorbent is mounted on the inner wall surface via the oil adhesion prevention means.

Other objects and further features of the present invention will be apparent from the following detailed description when read in conjunction with the accompanying drawings.

BEST MODE OF CARRYING OUT THE INVENTION

First Embodiment

Figure 1:
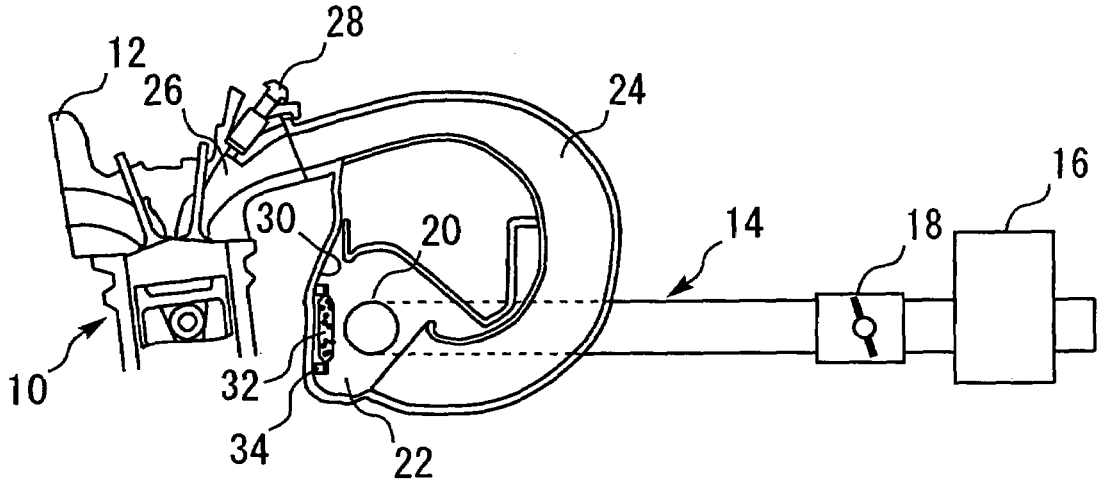
FIG. 1 illustrates the configuration of an internal combustion engine that includes an evaporative fuel adsorption device according to a first embodiment of the present invention.

FIG. 1 illustrates the configuration of an internal combustion engine 10 that includes an evaporative fuel adsorption device according to a first embodiment of the present invention. The internal combustion engine 10 includes a cylinder head 12. The cylinder head 12 communicates with an intake path 14. Within the intake path 14, a throttle body 18 is mounted downstream of an air cleaner 16.

The intake path 14, which is located downstream of the throttle body 18, communicates with a surge tank 22 via a tank inlet section 20. An intake manifold 24, which distributes intake air to each cylinder, is positioned on downstream of the surge tank 22. The intake manifold 24 is mounted on the cylinder head 12 to communicate with an intake port 26. The intake port 26 of each cylinder incorporates a fuel injection valve 28, which injects fuel into the port.

The internal combustion engine 10 shown in FIG. 1 includes an evaporative fuel adsorbent 32, which is mounted on a sidewall surface 30 within the surge tank 22. The evaporative fuel adsorbent 32 is capable of adsorbing evaporative fuel (HC), which remains in the intake path 14, while the internal combustion engine 10 is stopped. A retention member 34 is positioned between the evaporative fuel adsorbent 32 and the sidewall surface 30 of the surge tank 22 to prevent oil, which flows into the intake path 14 together with a blowby gas, from running down on the sidewall surface 30 and adhering to the evaporative fuel adsorbent 32. In other words, the evaporative fuel adsorbent 32 is mounted at a predetermined distance from the sidewall surface 30 with the retention member 34 positioned between the evaporative fuel adsorbent 32 and the sidewall surface 30.

A preferred mounting position for the evaporative fuel adsorbent 32 will now be described with reference to FIGS. 1 and 2.

The evaporative fuel remaining in the intake path 14 during an internal combustion engine stop is generated from fuel that is blown back into the intake path 14 from a combustion chamber of each cylinder during an internal combustion engine operation and from fuel that leaks out of the fuel injection valve 28, which is provided for each intake port 26, after the internal combustion engine 10 is stopped. To efficiently adsorb the evaporative fuel arising out of the above-mentioned sources, it is preferred that the evaporative fuel adsorbent 32 be positioned within the surge tank 22, which communicates with paths leading to all cylinders. Further, the evaporative fuel has a greater specific gravity than air. Therefore, it is preferred that the evaporative fuel adsorbent 32 be mounted at the lowest possible position within the intake path 14. Furthermore, it is preferred that the evaporative fuel adsorbent 32 be placed at a position at which oil and water are not likely to gather. As such being the case, the present embodiment assumes that the evaporative fuel adsorbent 32 is positioned under the sidewall surface 30 within the surge tank 22 as shown in FIG. 1.

Figure 2:
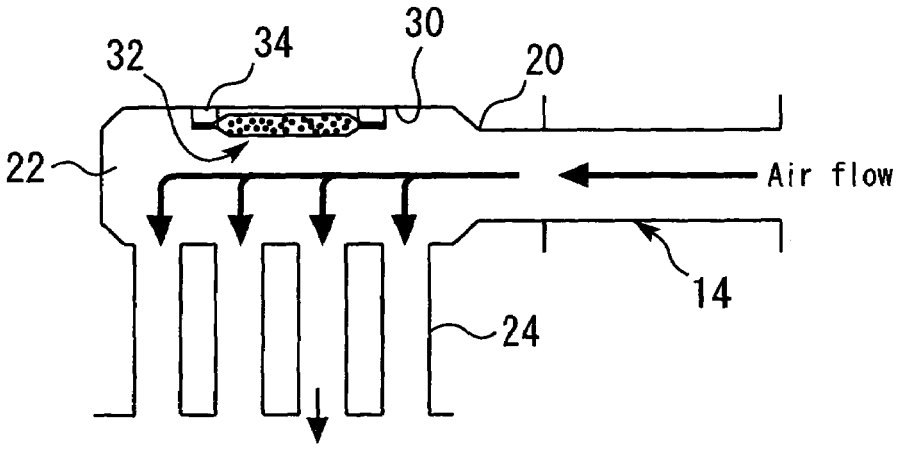
FIG. 2 shows how air flows within the intake path, which is shown in FIG. 1, while the internal combustion engine operates.

FIG. 2 shows how air flows within the intake path 14, which is shown in FIG. 1, while the internal combustion engine 10 operates. The evaporative fuel adsorbed by the evaporative fuel adsorbent 32 is removed from the evaporative fuel adsorbent 32 when a purge is performed with intake air during a subsequent operation of the internal combustion engine 10. It is therefore preferred that the evaporative fuel adsorbent 32 be positioned at a place where air flows. However, it is necessary to ensure that the flow of the intake air is not obstructed by the evaporative fuel adsorbent 32. As such being the case, the evaporative fuel adsorbent 32 according to the present embodiment is positioned substantially parallel to the sidewall surface 30 of the surge tank 22 and at an appropriate distance from the sidewall surface 30 so that the oil running down on the sidewall surface 30 does not adhere to the evaporative fuel adsorbent 32. The use of the above configuration inhibits the evaporative fuel adsorbent 32 from developing an increased intake resistance and permits the evaporative fuel adsorbent 32 to be positioned away from the sidewall surface 30.

Figure 3A:
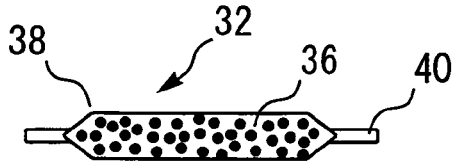
FIGS. 3A, 3B, and 3C illustrate the configuration and mounting structure of the evaporative fuel adsorbent.
Figure 3B:
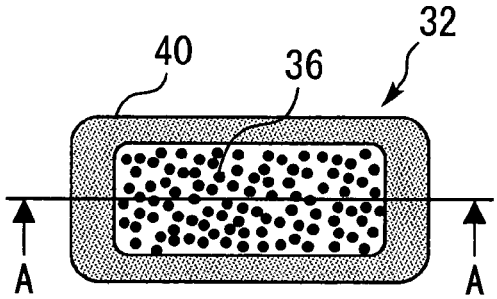
Figure 3C:
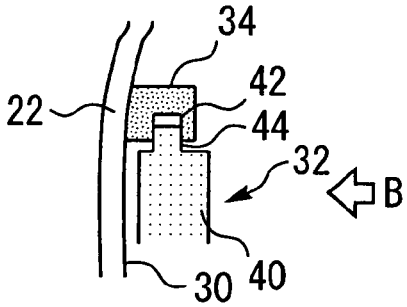

FIGS. 3A, 3B, and 3C illustrate the configuration and mounting structure of the evaporative fuel adsorbent 32. More specifically, FIG. 3C is an enlarged view illustrating an upper mounting section of the evaporative fuel adsorbent 32 shown in FIG. 1. FIG. 3B is an overall view of the evaporative fuel adsorbent 32, which is obtained when FIG. 3C is viewed in the direction of arrow B. FIG. 3A is a cross-sectional view of the evaporative fuel adsorbent 32 taken along line A—A in FIG. 3B.

The evaporative fuel adsorbent 32 is entirely shaped like a plate as shown in FIG. 3A. It comprises a granular adsorption element 36 (activated carbon or the like), which can adsorb evaporative fuel, and a case 38, which houses the adsorption element 36 while it is aerated. As shown in FIG. 3B, a rib 40 is formed on the circumference of the case 38 for the purpose of mounting the evaporative fuel adsorbent 32 on the retention member 34.

As shown in FIG. 3C, the retention member 34 is deposited on or rendered integral with the sidewall surface 30 of the surge tank 22. The retention member 34 has a concave 42 for engaging with the rib 40. The rib 40 has a convex 44 that corresponds to the concave 42. The use of this configuration makes it possible to mount the evaporative fuel adsorbent 32 at a distance from the sidewall surface 30 of the surge tank 22 while employing a simple mounting structure.

As described above, the evaporative fuel adsorption device according to the present embodiment prevents the oil running down on the sidewall surface 30 of the surge tank 22 from adhering to the evaporative fuel adsorbent 32 because the evaporative fuel adsorbent 32 is mounted via the retention member 34. The evaporative fuel adsorption device according to the present embodiment also permits the evaporative fuel adsorbent 32 to be placed at an appropriate position within the intake path 14. Consequently, the configuration according to the present embodiment steadily maintains the adsorption capacity of the evaporative fuel adsorbent 32.

In the first embodiment, which has been described above, the convex 44 is provided for the evaporative fuel adsorbent 32 with the concave 42 provided for the retention member 34 so that the evaporative fuel adsorbent 32 is mounted on the sidewall surface 30 of the surge tank 22 via the retention member 34. However, the present invention is not limited to such a mounting structure. For example, mounting structures shown in FIGS. 4 to 7 may be alternatively employed. The mounting structures shown in FIGS. 4 to 7 will be sequentially described. Only the upper mounting structures for the evaporative fuel adsorbent 32 will be described with reference to FIGS. 4 to 7. The lower mounting structures will not be described because they can be the same as the upper ones.

Figure 4:
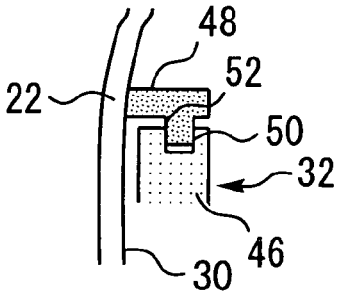
FIG. 4 illustrates a first modified mounting structure for the evaporative fuel adsorbent.

FIG. 4 illustrates a first modified mounting structure for the evaporative fuel adsorbent 32. The mounting structure shown in FIG. 4 differs from the one in FIG. 3C in that the rib 46 for the evaporative fuel adsorbent 32 is provided with a concave 50, which engages with the retention member 48, while the retention member 48 is provided with a convex 52, which corresponds to the concave 50.

Figure 5A:
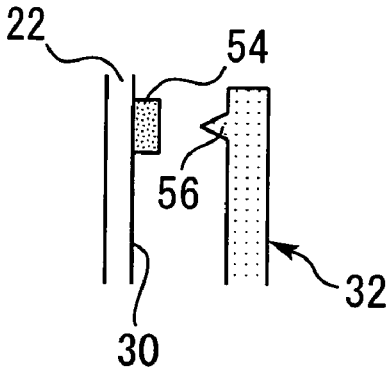
FIGS. 5A and 5B illustrate a second modified mounting structure for the evaporative fuel adsorbent.
Figure 5B:
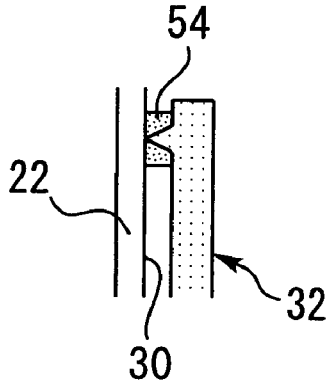

FIGS. 5A and 5B illustrate a second modified mounting structure for the evaporative fuel adsorbent 32. The mounting structure shown in FIGS. 5A and 5B is obtained by joining the evaporative fuel adsorbent 32 and retention member 54 by means of deposition (vibration deposition, hot plate deposition, laser deposition, etc.). FIG. 5A shows a state prevailing before deposition. FIG. 5B shows a state prevailing after deposition. As indicated in FIGS. 5A and 5B, the evaporative fuel adsorbent 32 has a protrusion 56, which joins with the retention member 54 through deposition. Therefore, deposition can be conducted so that the resulting clearance between the sidewall surface 30 and evaporative fuel adsorbent 32 is equivalent to the height of the protrusion 56. Consequently, dimensional control can be readily exercised over the clearance at a manufacturing stage.

Figure 6A:
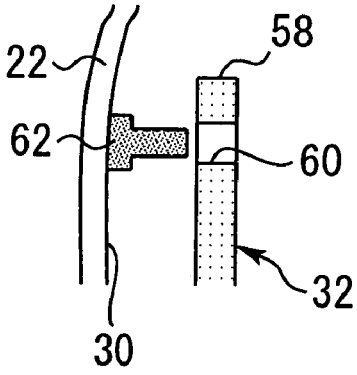
FIGS. 6A, 6B, and 6C illustrate a third modified mounting structure for the evaporative fuel adsorbent.
Figure 6B:
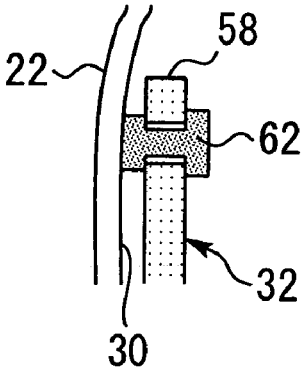
Figure 6C:
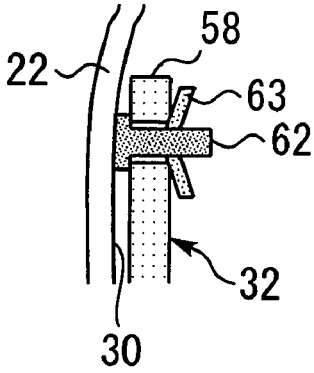

FIGS. 6A, 6B, and 6C illustrate a third modified mounting structure for the evaporative fuel adsorbent 32. As shown in FIG. 6A, the third mounting structure is such that the rib 58 for the evaporative fuel adsorbent 32 is provided with a through-hole 60 while the retention member 62 is provided as a pin. When the configuration shown in FIG. 6A is used, the rib 58 and retention member 62 can be joined by performing a tightening procedure with the rib 58 inserted into the retention member 62 as indicated in FIG. 6B. The configuration shown in FIG. 6A also makes it possible to join the rib 58 and retention member 62 with a fitting 63 as indicated in FIG. 6C.

Figure 7A:
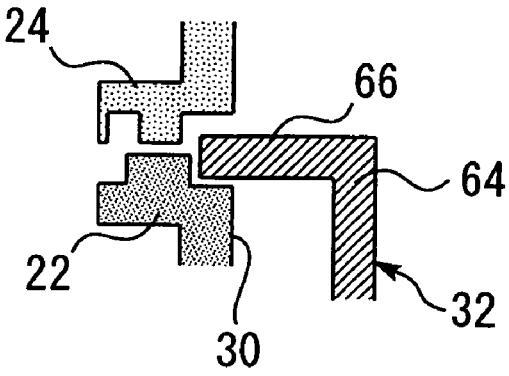
FIGS. 7A and 7B illustrate a fourth modified mounting structure for the evaporative fuel adsorbent.
Figure 7B:
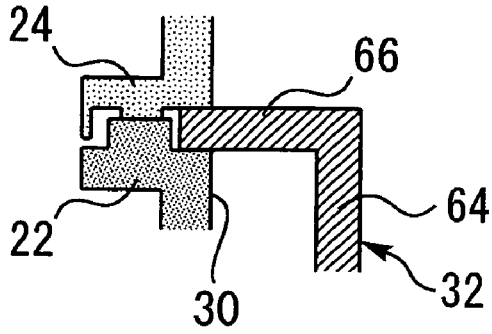

FIGS. 7A and 7B illustrate a fourth modified mounting structure for the evaporative fuel adsorbent 32. FIGS. 7A and 7B indicate a method for integrating the surge tank 22 and intake manifold 24 into a single whole by means of deposition. In the example shown in FIG. 7A, the evaporative fuel adsorbent 32 is provided with a flange 66, which is orthogonal to the end of the rib 64. In other words, the retention member in the example is formed as the flange 66, which is integral with the rib 64. Further, when the flange 66 is sandwiched between the surge tank 22 and intake manifold 24, the resulting configuration permits the evaporative fuel adsorbent 32 to be mounted at a distance from the sidewall surface 30 via the retention member (flange 66). The lower mounting structure can be installed by a method indicated in another example above.

In the first embodiment, which has been described above, the evaporative fuel adsorbent 32 is mounted at a distance from the sidewall surface 30 via the retention member 34 so as to prevent the oil running down on the sidewall surface 30 of the surge tank from adhering to the evaporative fuel adsorbent 32. However, the present invention is not limited to such a configuration. An alternative for oil adhesion avoidance is to use the sidewall surface 30 of the surge tank 22 as a retention member for mounting the evaporative fuel adsorbent 32 at a distance from the sidewall surface 30 of the surge tank 22.

Figure 8:
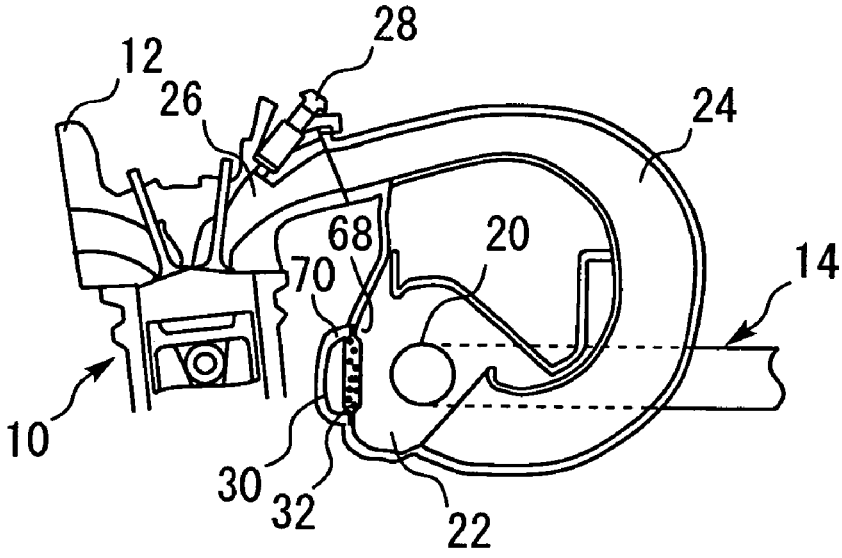
FIG. 8 illustrates the modified structure according to the first embodiment of the present invention.

FIG. 8 illustrates the configuration of the above alternative mounting structure. The configuration shown in FIG. 8 includes a bulge 70, which is formed as a part of the sidewall surface 30 of the surge tank 22. More specifically, the sidewall surface 30 is formed so as to bulge toward the evaporative fuel adsorbent 32 within the vicinity of the rib 68 for the evaporative fuel adsorbent 32, as indicated in the example shown in FIG. 8, for the purpose of providing a clearance between the evaporative fuel adsorbent 32 and the sidewall surface 30, which is located behind the evaporative fuel adsorbent 32. In other words, the bulge 70 corresponds to the retention member according to the present invention. Even when this configuration is employed, a space can be provided between the rear surface of the evaporative fuel adsorbent 32 and the sidewall surface 30. It is therefore possible to prevent the oil running down on the sidewall surface 30 from adhering to the evaporative fuel adsorbent 32.

In the first embodiment, which has been described above, the retention member 34 corresponds to the "oil adhesion prevention means" according to the first aspect of the present invention.

Second Embodiment

A second embodiment of the present invention will now be described with reference to FIGS. 9A and 9B.

Figure 9A:
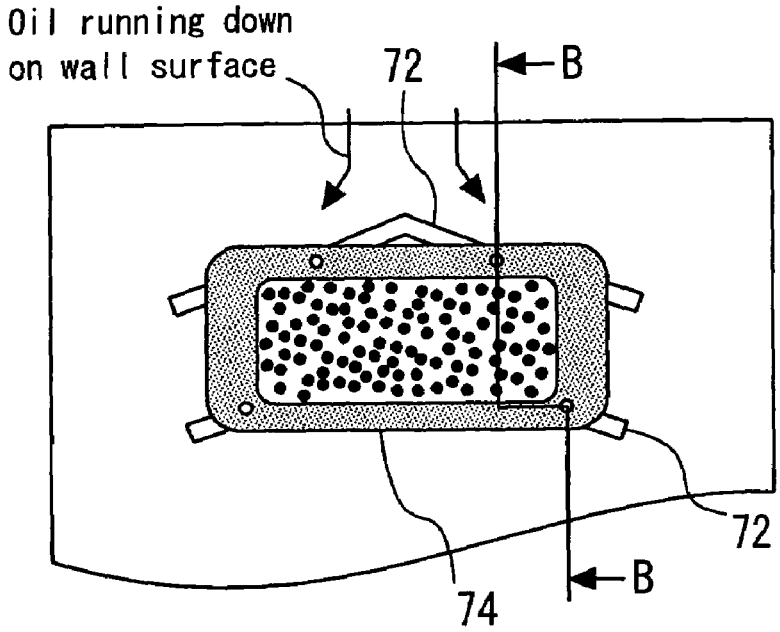
FIGS. 9A and 9B illustrate how the evaporative fuel adsorption device according to the second embodiment of the present invention is mounted.
Figure 9B:
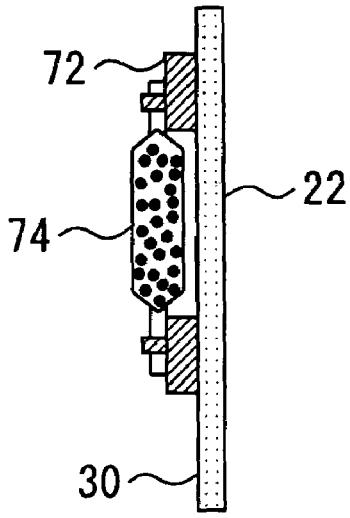

FIGS. 9A and 9B illustrate how the evaporative fuel adsorption device according to the second embodiment of the present invention is mounted. More specifically, FIG. 9A is obtained when the evaporative fuel adsorption device is viewed in the mounting direction, whereas FIG. 9B is a cross-sectional view of the evaporative fuel adsorption device taken along line B—B in FIG. 9A.

The evaporative fuel adsorption device according to the present embodiment is configured the same as the evaporative fuel adsorption device according to the first embodiment except that the shape of the retention member 72 is changed. As shown in FIGS. 9A and 9B, the evaporative fuel adsorption device according to the present embodiment is also configured so that the evaporative fuel adsorbent 74 is mounted at a predetermined distance from the sidewall surface 30 of the surge tank 22 via the retention member 72.

As shown in FIG. 9A, the upper retention member 72 is formed as a wall that covers the whole width (the width in the horizontal direction in FIG. 9A) of the evaporative fuel adsorbent 74 and declines to the right and left with the widthwise center placed at the highest position. This also holds true for the lower retention member 72. When this configuration is employed, the oil coming down on the sidewall surface 30 branches to the right and left due to the retention member 72. As described above, the retention member 72 according to the present embodiment not only serves as a retention member for permitting the evaporative fuel adsorbent 74 to be positioned at a predetermined distance from the sidewall surface 30, but also serves a guide member for preventing the oil from flowing to the rear surface of the evaporative fuel adsorbent 74. Consequently, the configuration according to the present embodiment, in which the retention member 72 has a sloped surface, smoothly guides the oil, which attempts to flow to the adsorption surface of the evaporative fuel adsorbent 74, to a place apart from the adsorption surface, and prevents the oil from flowing to the adsorption surface, which is located below the sloped surface. Further, the retention member 74 having the above-mentioned sloped surface ensures that no oil gathers on the sloped surface.

As described above, the evaporative fuel adsorption device according to the present embodiment has a guide member (retention member 72), which is positioned in a sloped direction relative to the direction of downward oil flow to the evaporative fuel adsorbent 74. Therefore, the evaporative fuel adsorption device according to the present embodiment prevents the oil from flowing to the rear surface of the evaporative fuel adsorbent 74. Consequently, the evaporative fuel adsorption device according to the present embodiment prevents the oil from adhering to the evaporative fuel adsorbent 74 with higher certainty than the evaporative fuel adsorption device according to the first embodiment.

In the second embodiment, which has been described above, the retention member 72, which is fastened to the upper and lower ribs of the evaporative fuel adsorbent 74, functions as a guide member. However, the present invention is not limited to such a guide member configuration, which prevents the oil from flowing to the rear surface of the evaporative fuel adsorbent 74. In a typical alternative guide member configuration, only the upper retention member 72 functions as a guide member. In other words, retention member may include a guide portion that is slanted in relation to the downstream direction of oil running downward toward said evaporative fuel absorbent 74. Further, the wall functioning as a guide member is not limited to the one shown in FIG. 9. An alternative wall may decline widthwise from one end to the other end of the evaporative fuel adsorbent 74. Another alternative wall may surround the greater part or entire circumference of the rib of the evaporative fuel adsorbent 74.

In the second embodiment, which has been described above, the retention member 72 (guide member) corresponds to the "oil adhesion prevention means" according to the first aspect of the present invention.

The major features and benefits of the present invention described above are summarized as follows:

The first aspect of the present invention includes an evaporative fuel adsorption device which includes an evaporative fuel adsorbent disposed in an intake path to adsorb evaporative fuel. A oil adhesion prevention means that is positioned between an inner wall surface of the intake path and the evaporative fuel adsorbent to prevent oil running down on the inner wall surface from adhering to the evaporative fuel adsorbent is provided. The evaporative fuel adsorbent is mounted on the inner wall surface via the oil adhesion prevention means.

In the second aspect of the present invention, the evaporative fuel adsorbent may be positioned substantially parallel to the inner wall surface of the intake path.

In the third aspect of the present invention, the oil adhesion prevention means may be a retention member for mounting the evaporative fuel adsorbent at a predetermined distance from the inner wall surface.

In the fourth aspect of the present invention, the retention member may include a guide portion that is slanted in relation to the downstream direction of oil running downward toward the evaporative fuel absorbent.

In the fifth aspect of the present invention, the oil adhesion prevention means may be a guide member that is slanted in relation to the downstream direction of oil running downward toward the evaporative fuel adsorbent.

According to the first aspect of the present invention, the evaporative fuel adsorbent is mounted on the intake path via the oil adhesion prevention means. Therefore, it is possible to prevent the oil, which runs down on the inner surface, from adhering to the evaporative fuel adsorbent. As a result, the present aspect of the invention steadily maintains the adsorption capacity of the evaporative fuel adsorbent.

According to the second aspect of the present invention, it is possible to inhibit the evaporative fuel adsorbent from developing an increased intake resistance.

According to the third aspect of the present invention, it is possible to effectively prevent the oil, which runs down on the inner surface, from adhering to the evaporative fuel adsorbent.

According to the fourth or fifth aspect of the present invention, it is possible to prevent the oil, which runs down on the inner surface, from flowing to the rear surface of the evaporative fuel adsorbent. Consequently, the present aspect of the invention prevents the oil from adhering to the evaporative fuel adsorbent with increased certainty.

Further, the present invention is not limited to these embodiments, but variations and modifications may be made without departing from the scope of the present invention.

The invention claimed is:

1. An evaporative fuel adsorption device comprising:

an evaporative fuel adsorbent disposed in an intake path to adsorb evaporative fuel; and oil adhesion prevention means that is positioned between an inner wall surface of said intake path and said evaporative fuel adsorbent to prevent oil running down on said inner wall surface from adhering to said evaporative fuel adsorbent;

wherein said evaporative fuel adsorbent is mounted on said inner wall surface via said oil adhesion prevention means.

2. The evaporative fuel adsorption device according to claim 1, wherein said evaporative fuel adsorbent is positioned substantially parallel to said inner wall surface of said intake path.

3. The evaporative fuel adsorption device according to claim 1, wherein said oil adhesion prevention means is a retention member for mounting said evaporative fuel adsorbent at a predetermined distance from said inner wall surface.

4. The evaporative fuel adsorption device according to claim 3, wherein said retention member includes a guide portion that is slanted in relation to the downstream direction of oil running downward toward said evaporative fuel absorbent.

5. The evaporative fuel adsorption device according to claim 3, wherein said oil adhesion prevention means is a guide member that is slanted in relation to the downstream direction of oil running downward toward said evaporative fuel adsorbent.

* * * * *